United States Patent [19]

Takino et al.

[11] Patent Number: 4,533,316

[45] Date of Patent: Aug. 6, 1985

[54] VAPORIZING TYPE FUEL COMBUSTION APPARATUS WITH TAR REMOVAL DEVICE

[75] Inventors: Kenichi Takino, Yao; Eiji Yamasaki, Nara; Kenji Murakami, Takaishi, all of Japan

[73] Assignee: Sharp Kabushiki Kaisha, Osaka, Japan

[21] Appl. No.: 328,664

[22] Filed: Dec. 8, 1981

[30] Foreign Application Priority Data

Dec. 8, 1980 [JP] Japan ..... 55-176001
Dec. 10, 1980 [JP] Japan ..... 55-174973

[51] Int. Cl.[3] ..... F23N 5/24

[52] U.S. Cl. ..... 431/32; 431/3; 431/41; 431/121; 431/208

[58] Field of Search ..... 431/3, 29, 32, 41, 121, 431/208, 11, 240, 241, 37; 210/184, 186, 416.4, 446; 239/575, 590

[56] References Cited

U.S. PATENT DOCUMENTS

| | | | |
|---|---|---|---|
| 2,045,895 | 6/1936 | Björklund | 431/121 X |
| 2,507,464 | 5/1950 | De Andrade Só | 431/241 X |
| 3,118,490 | 1/1964 | Page-Roberts et al. | 431/37 |
| 3,337,052 | 8/1967 | Knieriem, Jr. | 210/184 |
| 3,869,242 | 3/1975 | Schladitz | 431/11 |
| 3,984,310 | 10/1976 | Calderon | 431/32 |
| 4,032,453 | 6/1977 | Pedone | 210/435 |
| 4,043,741 | 8/1977 | Moss et al. | 431/3 |

FOREIGN PATENT DOCUMENTS

| | | | |
|---|---|---|---|
| 2717171 | 11/1978 | Fed. Rep. of Germany | 431/41 |
| 976747 | 11/1950 | France | 431/208 |

*Primary Examiner*—Samuel Scott
*Assistant Examiner*—Allen J. Flanigan
*Attorney, Agent, or Firm*—Birch, Stewart, Kolasch & Birch

[57] ABSTRACT

There is disclosed a combustion apparatus of a fuel vaporizing type wherein fuel is led to a fuel injector for vaporization and the vaporized fuel is fed to a burner via a gas nozzle for combustion. The combustion apparatus features the provision of a device for removing at a high temperature tar attached in the fuel injector. Preferably, the removal of the tar is accomplished by fuel-empty burning. Therefore, there is no possibility that tar is deposited in the fuel injector, resulting in no faulty or incomplete combustion nor an accident to the combustion apparatus. It is further unnecessary to exchange the fuel injector or a vaporizing core installed therein or clear the interior of the fuel injector. The combustion apparatus demands only the fuel-empty burning device for the removal of tar with high temperature heating and is of simple and low cost structure. Controls are further provided for keeping constant the temperature of the fuel injector during fuel-empty burning. This provides an effective way to avoid an overheated state of the fuel injector itself and destruction of a heater or other constituting components, ensuring power savings in empty-free burning.

5 Claims, 8 Drawing Figures

VAPORIZING TYPE FUEL COMBUSTION APPARATUS WITH TAR REMOVAL DEVICE

BACKGROUND OF THE INVENTION

This invention relates to a fuel combustion apparatus of the vaporizing type wherein fuel is heated and vaporized within a fuel injector and then fed to a burner via a nozzle for combustion, and more particularly to a device and method for removing tar produced within the fuel injector.

While kerosene is being vaporized within a fuel injector of a conventional fuel combustion apparatus of the vaporizing type during combustion, kerosene is reduced slowly into tar due to polymerization of molecules, microscopic residues (impurities), etc. at a vaporizing temperature (within a range of about 150° to about 280° C.) and the growth of tar proceeds steadily within the fuel injector and a vaporizing core as combustion time goes on. The amount of the tar growth is somewhat different depending upon the internal temperature of the fuel injector, the manner in which the kerosene is vaporized and the temperature rises in the kerosene. However, the growth of tar is unavoidable.

As the tar is attached and deposited in the fuel injector and the vaporizing core, a passage for the vaporized kerosene is choked gradually with the tar, so that the proportion of the vaporized oil gas decreases and the rate of combustion slows down, causing a faulty combustion state and eventually shortening the life of the combustion apparatus. A solution to the problem is to exchange components of the fuel injector and the stabilizer every two or three years but this solution is unsatisfactory and not practical.

OBJECT AND SUMMARY OF THE INVENTION

Accordingly, it is an object of the present invention to provide a device and method for removing tar deposited in a fuel injector and a vaporizing core through fuel-empty burning (this is used to refer to a burning which is aided only with residual fuel in a wick or other burners without fuel being fed to the wick or the like).

It is another object of the present invention to provide a fuel combustion apparatus which is reliable during an extended period of use without the need to exchange the vaporizing core.

According to the present invention, there is provided a combustion apparatus of a fuel vaporizing type wherein fuel is supplied to a fuel injector for vaporization and the vaporized fuel is fed to a burner via a gas nozzle for combustion. The combustion apparatus is characterized by the provision of means for removing tar at a high temperature which is attached within the fuel injector. Preferably, the removal of the tar is accomplished by fuel-empty burning. Therefore, there is no possibility that tar is deposited in the fuel injector, resulting in faulty or incomplete combustion or perhaps an accident to the combustion apparatus. It is further unnecessary to exchange the fuel injector or a vaporizing core installed therein or clear the interior of the fuel injector. The combustion apparatus embodying the present invention demands only the fuel-empty burning means for the removal of tar with high temperature heating and is of simple and low cost construction.

In another aspect of the present invention, means are further provided for keeping constant the temperature of the carburetor during fuel-empty burning. This provides an effective way to avoid an overheated state of the fuel injector itself and destruction of a heater or other constituting components, ensuring power savings during fuel-empty burning.

The inventor's experiments were carried out on a fuel injector of a Bunsen burner system. In the experiments a fuel injector was provided with a heater (typically, 350 W) and a temperature control capable of controlling the temperature of the fuel injector at a given vaporizing temperature (a range from 240° to 280° C.) and the internal temperature of the fuel injector was elevated to 450°–500° C. by short-circuiting the temperature control and energizing the heater continuously. The fuel injector and the vaporizing core were subject to fuel-empty burning in a high temperature atmosphere. The results of those experiments were as follows:

| | 1 hr Empty Burning | | 2 hr Empty Burning | |
|---|---|---|---|---|
| | forced circulation | natural convection | forced circulation | natural convection |
| (1) vapor core with paraffin tar | 70–80% of tar removed | some 70% of tar removed | over 90% of tar removed | 80–90% of tar removed |
| (2) vapor core with altered kerosene tar | 40–50% of tar removed | | 50–60% of tar removed | |

It is believed that the data would be more satisfactory when fuel-empty burning is effected before the vaporizing core is choked completely with tar.

In the foregoing table, "forced circulation" is used to define a method by which a fuel pump is freely operated to pump air into the fuel injector (3–5 cc/min) and "natural convection" is used to define a method by which the pump is interrupted to permit air to return naturally to the fuel injector by way of a forward pipe and a return pipe.

The results of the experiments reveal that, provided that the stabilizer was subject to fuel-empty burning at an atmosphere of some 500° C. for 1 or 2 hours, the vaporizing core was able to be restored from an incomplete combustion state caused by loaded tar to an almost complete or normal combustion state. However, when the stabilizer is subjected to fuel-empty burning at 300° C., it gained 20% or less recovery. As noted previously, the present invention offers an effective and successful measure by which to maintain a highly durable operation of the combustion apparatus for an extended period of use without the need to exchange the stabilizers.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
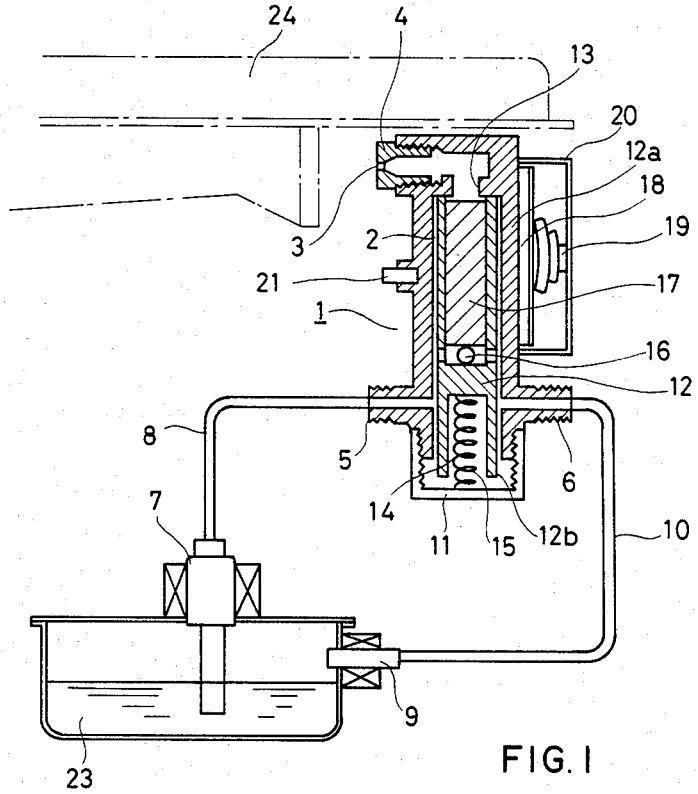
FIG. 1 is a schematic view of a vaporizing type fuel combustion apparatus according to the present invention.

A fuel injector generally designated by 1 includes a main body typically constructed of brass. The main body includes a vaporizing chamber 2 defined therein and carries a gas nozzle 4 having an orifice 3 detachably screwed to an upper portion thereof and a fuel feed conduit 8 and a return conduit 10 extending from joints 5 and 6 at lower side walls thereof. The fuel feed conduit 8 is in communication with a fuel pump 7 while the return conduit 10 is in communication with an electromagnetic valve of the normally "closed" type which is in closed position when being energized. A cap 11 is detachably placed to cover an open bottom edge of the fuel injector main body 1.

A cylindrically-shaped vaporizing cylinder 12 typically made of brass is inserted from the open bottom edge into the vaporizing chamber 2 and is composed of an upper cylinder 12*a* and a lower cylinder 12*b*. The top edge of the cylinder is engaged with an inwardly oriented flange 13 and the bottom thereof is somewhat positioned to extend from the open bottom edge of the vaporizing chamber 2 to facilitate the removal of the vaporizing core 17. The lower cylinder 12*b* has a depression 14 for receiving a spring 15 which always biases upwardly the vaporizing cylinder 12. The bottom of the upper cylinder 12*a* (that is, in the vicinity of the joint with the lower cylinder 12*b*) has a plurality of perforations 16 for communication between the interior and exterior of the cylinder 12*a*. A vaporizing core 17 of porous metal or sintered metal is installed within the upper cylinder 12*a* of the cylinder 12 to be easily removable from the vaporizing chamber 2 together with the cylinder 12.

A heater 18 is seated tightly on a side wall of the fuel injector body 1 and constantly biased toward the fuel injector body 1 by the force of a spring 19, the periphery of which is surrounded by a cover 20. During a normal combustion state the heater 18 operates so as to maintain the interior of the fuel injector 2 at a temperature of 240° to 280° C. under the control of a temperature-monitoring element 21 (typically, a positive characteristic thermistor) and an electronic control 22. When it is desired to conduct the fuel-empty burning, the temperature-monitoring element 21 is short-circuited, interrupting operation of the electronic control 22 and establishing a continued heating mode. As a result, the internal temperature of the fuel injector 2 reaches about 500° C. A fuel tank is designated by 23 and a burner is designated by 24.

Figure 2:
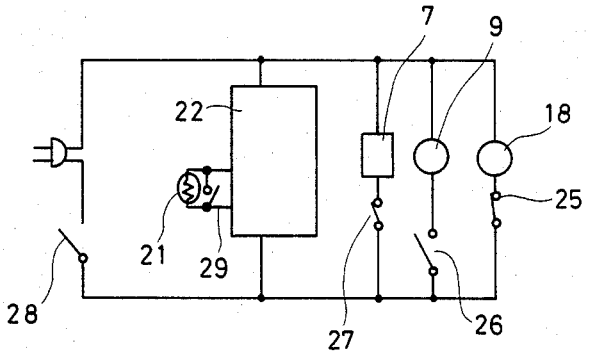
FIG. 2 is a circuit diagram of the vaporizing type fuel combustion apparatus.

FIG. 2 shows a schematic electric wiring of the vaporizing type fuel combustion apparatus according to the present invention. The heater 18 is connected serially with a normally closed type relay switch 25 which is switched on and off by the electronic control 22. A series circuit of the heater 18 and the relay switch 25 is connected in parallel with a series circuit of the electromagnetic valve 9 and a normally open type relay switch 26 which is placed into closed position by the electronic control 22 when the temperature of the fuel injector 2 reaches a given value (within 240°–280° C.).

A switch 27 is connected serially with the temperature-monitoring element 21 and is switched on and off in response to a main switch 28 for forced circulation and switched on and off manually for natural convection during the fuel-empty burning. A switch 29 is connected in parallel with the temperature-monitoring element 21 and is switched on to short-circuit the temperature-monitoring element 21 and inhibit operation of the electronic control prior to the fuel-empty burning of the fuel injector.

The operation of the vaporizing type fuel combustion apparatus according to the present invention will now be described briefly. When it is desired to initiate normal combustion, the main switch 28 is switched on and the switch 27 also is switched on so that the fuel pump 7 is actuated and the heater 18 is energized, thus heating the fuel injector main body 1.

Because the temperature of the fuel injector main body 1 is initially low, the relay switch 26 is in the off position and the electromagnetic valve 9 is in the open position. Through operation of the fuel pump 7 fuel is drawn in a vertical direction from the fuel tank 23 and introduced into the fuel injector body 1 by way of the fuel conduit 8 (running through a space between an inner wall of the fuel injector body 1 and an outer wall of the vaporizing core 12). The fuel is then returned to the fuel tank 23 via the electromagnetic valve 9, completing a circulation loop.

When the temperature of the fuel injector 1 reaches the predetermined value through operation of the heater 18, the resistance of the temperature-monitoring element 21 varies drastically so that the electronic control 22 starts operating and closes the relay switch 26. Accordingly, the electromagnetic valve 9 is energized to shut off the return path, so that the level of the fuel entering the fuel injector 1 increases gradually. The fuel then permeates the vaporizing cylinder 17 and becomes vaporized from the heat from the heater 18. The vaporizing temperature is 240°–280° C. under these conditions. The duration of power supply to the heater 18 is regulated by the relay switch 25 responsive to the electronic control 22 so that the internal temperature of the vaporizing chamber 2 is maintained between 240° and 280° C. The vaporized fuel gas in the fuel injector 2 is fed via the orifice 3 of the nozzle 4 into the burner 24 which in turn conducts normal combustion.

The fuel-empty burning will be carried out on the fuel injector in the following manner. If the fuel pump 7 is driven and the fuel-empty burning is effected under the forced circulation state, then the residual fuel in the fuel tank 23 should be removed completely and the short switch 29 be turned on to inhibit the electronic control 22 from operating. The main switch 28 is turned on, initiating continued energization of the heater 18 and feeding air to the fuel injector 1 due to idle operation of the fuel pump 7. Consequently, the temperature in the fuel injector 1 reaches 500° C. and tar attached to the fuel injector 1 and the vaporizing cylinder 12 is thermally dissolved and finally removed.

When the fuel-empty burning is desired with natural convection without driving the fuel pump 7, the switch 27 is manually switched off and the same procedure as discussed in the above paragraph is carried out. In this case, air supply is achieved on the end of the fuel injector 2 by way of the normally open type electromagnetic valve 9. It is obvious that the fuel-empty burning may be conducted only for a limited period of time within warm-up time whenever combustion is effected. The fuel-empty burning takes only a small amount of time, for the amount of the tar is very small.

Figure 3:
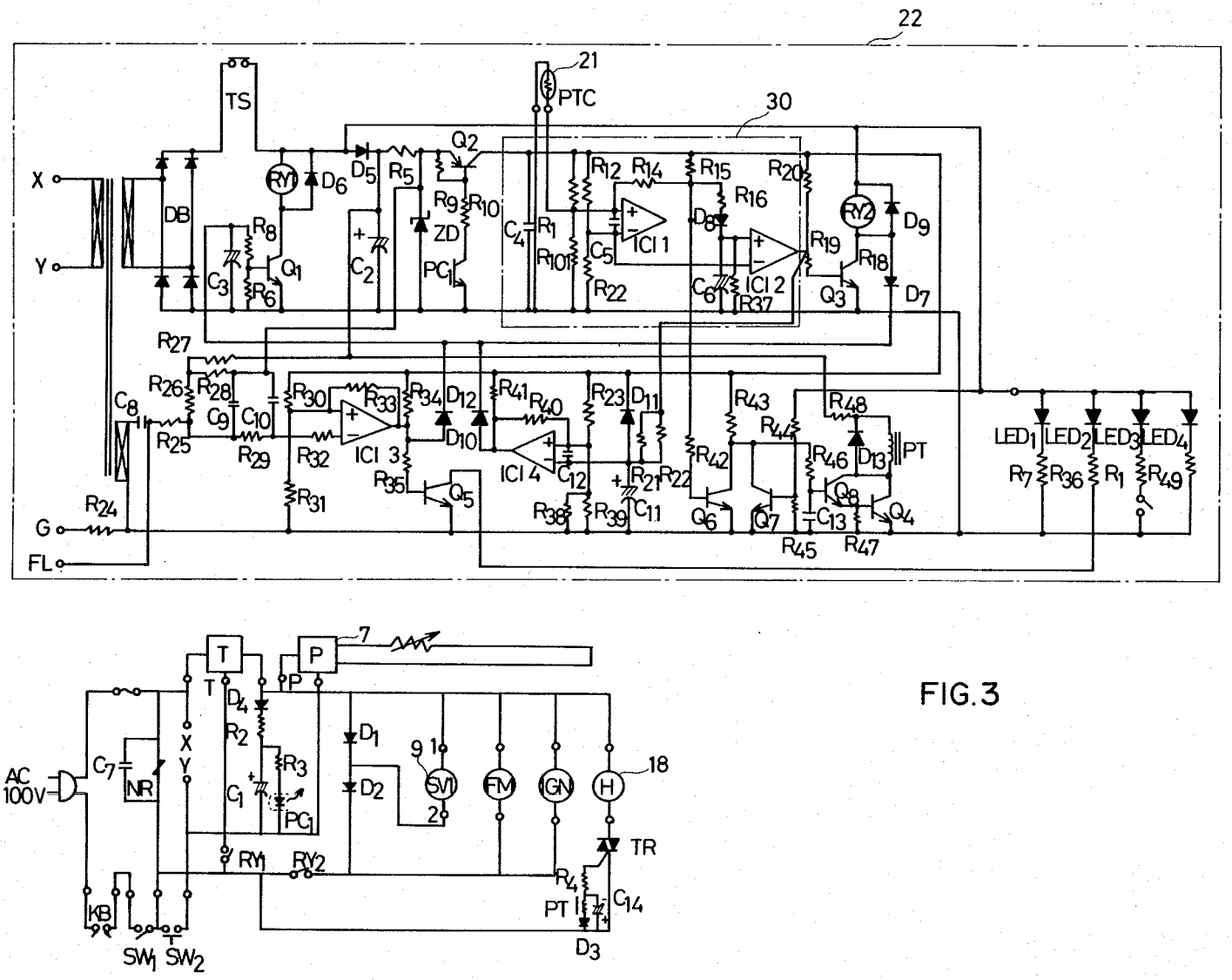
FIG. 3 is a detailed circuit diagram of the vaporized type fuel combustion apparatus.

Details of the circuit of the vaporizing type fuel combustion apparatus embodying the present invention will be clarified from a review of FIG. 3. The positive characteristic thermistor 21 is connected to constantly maintain the temperature of the fuel injector 1. Power switches $SW_1$ and $SW_2$ are interlocked with each other, with the switch $SW_1$ serving as an automatic clear switch. Power transformers $X_1$ and $Y_1$ are provided for the electronic circuit together with a timer T for controlling the beginning and end of combustion, magnet relays $RY_1$ and $RY_2$, a pulse transformer PT, a diode D, a capacitor C, resistors $R_1$, $R_2$ and so forth, transistors $Q_1$, $Q_2$ and so forth, comparators $IC_{1-1}$–$IC_{1-4}$, an anti-earthquake switch TS, a ground terminal G, a flame rod FL and a light emitting diode LED.

When the switches $SW_1$ and $SW_2$ are turned on ($SW_1$ is switched on only for a very short length of time), a voltage is applied to the primary windings $X_1$ and $Y_1$ of the transformer which in turn develops a voltage on its secondary side. $Q_1$ is turned on via an excitation coil of $RY_2$, $R_{18}$, $D_7$ and $R_8$ so that the relay $RY_1$ is held in an enabled state and the pilot lamp LED is fired regardless of the switch $SW_2$ being in an on position.

If the timer T is in either a "continued mode" or "time expire mode", then the pump 7 is activated and a photocoupler $PC_1$ becomes conductive via $D_4$, $R_2$ and $R_3$. Because the phototransistor of $PC_1$ is turned on, a voltage is applied to the base of the transistor $Q_2$ to thereby turn on $Q_2$ and supply a voltage to the comparator $IC_{1-1}$. The positive characteristic thermistor 21 is low in temperature and thus in resistance so that the output of $IC_{1-1}$ is low and the transistor $Q_6$ are still off.

Base current, after full-wave rectification, flows through the transistor $Q_7$ via $R_{44}$ and $Q_7$ is off at the point in time when the current is zero in amplitude, and $C_{13}$ is charged via $R_{43}$ and $R_{46}$. Once $Q_8$ has been turned on, a charge on $C_{13}$ is discharged to the bases of the transistors $Q_8$ and $Q_4$ which in turn are switched on temporarily and current flows through the excitation coil of the pulse transformer PT. The result is that a triac TR is energized. It is noted that $Q_8$ is turned off in response to $Q_7$ being turned on. The triac TR triggered with zero-crossing brings the heater 18 into the operating state.

As the fuel injector 1 is heated with the heater 18, the positive characteristic thermistor 21 installed in the fuel injector shows an increase in resistance and the output of the comparator $IC_{1-1}$ inverts from "low" to "high." As a result, the transistor $Q_6$ is turned on to inhibit pulse supply to the pulse transformer and places the triac TR into an off position and eventually disables the heater 18.

A plus input to $IC_{1-2}$ is admitted via $R_{16}$, $D_8$ and $C_6$ which results in inversion of the output of $IC_{1-2}$ from "low" to "high". Accordingly, the transistor $Q_3$ is switched on to energize $RY_2$, an ignitor IGN, a convection blower FM and the electromagnetic valve 9. Because of the magnet relay $RY_2$ is on, it does not receive any self-holding signal from $R_{18}$ and $D_7$ but from $IC_{1-4}$ via $D_{12}$ and $D_8$. This result is due to the whole electronic circuit 21 being supplied with a voltage once the transistor $Q_2$ has been switched on.

When the gas fuel from the fuel injector 1 is fired with a spark discharge originating from the ignitor IGN, the flame rod FL shows a decrease in flame resistance and the voltage level at a minus terminal of the comparator $IC_{1-3}$ declines so that the output of $IC_{1-3}$ changes from "low" to "high." When this occurs, $Q_5$ is switched on and the $LED_2$ is fired. The hold signal is fed to the base of $Q_1$ via $R_{34}$, $D_{10}$ and $R_8$.

Shortly after the output of $IC_{1-2}$ become "higher" (completion of preheating), the output of $IC_{1-2}$ increases the potential at $C_{11}$ to a "high" value and inverts the output of $IC_{1-4}$ from "high" to "low." Therefore, the hold signal no longer appears from $R_{41}$, $D_{12}$ and $R_8$. In the absence of the output from $IC_{1-3}$, $Q_1$ is off and $RY_1$ is also off so that $RY_1$ is set free from a self-holding state to thereby discontinue operation. In other words, in the event that fuel is not burned regardless of the ignitor IGN causing spark discharge for a given length of time, the apparatus is automatically discontinued from further operating. As soon as combustion starts, the output of the comparator $IC_{1-1}$ switches repeatedly between "high" and "low" in response to the output of the thermistor 21, thus switching on and off the heater 18 with the intention of keeping the fuel injector 1 at 150°–280° C. It is understood that even if the output of $IC_{1-1}$ becomes "lower" $IC_{1-2}$ maintains a "high" output due to the charge discharged from $C_6$ but is placed into an off position in the absence of any charge from $IC_{1-1}$ for a limited period of time.

Figure 4:
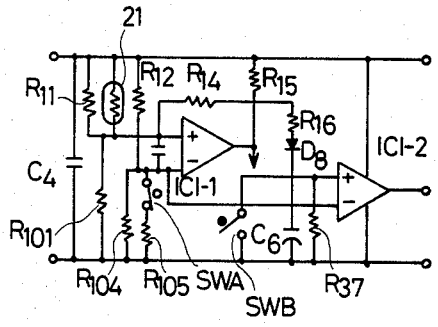
FIG. 4 is a circuit diagram of a principal part of the vaporizing type fuel combustion apparatus.

Circuit expenditures for the fuel-empty burning are shown in FIG. 4. A circuit of FIG. 4 is to be placed into the circuit block 30 in FIG. 3 as defined by the phantom line, wherein the same components are depicted by the same reference numbers similar to those in FIG. 3. Referring to FIG. 4, resistors $R_{104}$ and $R_{105}$, and fuel-empty burning switches $SW_A$ and $SW_B$ are additionally provided. With such an arrangement, the fuel-empty burning may be effected at once upon actuation of the switches $SW_A$ and $SW_B$ anytime before the beginning of combustion or in the course of combustion.

When both the switches $SW_1$ and $SW_2$ are switched on, the electronic circuit 21 becomes operable to effect self-holding and pre-heating. Although the level at one end of $IC_{1-1}$ is supplied with a voltage as determined by the combined resistance of $R_{12}$, $R_{105}$ and $R_{104}$, it is supplied with a different voltage as determined by the combined resistance of $R_{12}$ and $R_{104}$, with the latter being higher than the former. $IC_{1-1}$ will not deliver an output unless the potential at the plus side of $IC_{1-1}$ is higher than the normal level or the temperature is higher. Therefore, temperature control in the fuel-empty burning is effected within a higher range than that of the normal burning state (for example, within 300°–500° C.). While the above described procedure proceeds in the presence of the output from $IC_{1-1}$ (completion of warm-up), the output from $IC_{1-1}$ flows via $R_{16}$, $D_8$ and $SW_B$ in this case because of $SW_B$ being in a closed position so that the output of the comparator $IC_{1-2}$ does not show a transition from "low" to "high" and keeps "low." Therefore, no ignition takes place. The output of $IC_{1-1}$ renders $Q_6$ to be operable to perform temperature regulation as in the normal combustion state.

It is therefore possible to effect temperature regulation within the range higher than that in the normal combustion state by actuation of $SW_1$ and $SW_2$ and the fuel-empty burning $SW_A$ and $SW_B$. When it is desired to stop the fuel-empty burning, the switches $SW_A$ and $SW_B$ are restored to the original position.

In the event that $SW_A$ and $SW_B$ are actuated in the course of combustion, $SW_A$ is opened and the controlling temperature varies at the same time. When $SW_B$ is closed, the output of $IC_{1-1}$ flows through $R_{16}$, $D_8$ and $SW_B$ but does not flow toward $IC_{1-2}$. However, since the comparator $IC_{1-2}$ provides an output for a specific period of time as determined by the capacitance of $C_6$ the charge on $C_6$, $Q_3$ stands continuously in an on position. Upon the expiration of the specific period of time $Q_3$ is switched off to thereby disenergize $RY_2$ and discontinue combustion. At this time the output previously holding $Q_1$ is released from $IC_{1-3}$ and will flow into $Q_1$ to no longer hold upon discontinued combustion. However, because $RY_2$ is deenergized, $Q_1$ is held on by the output passing through the excitation coil of $RY_2$, $R_{18}$, $D_7$ and $R_8$ instead of the output of $IC_{1-3}$. As described above, even if the fuel-empty burning $SW_A$ and $SW_B$ are depressed in the course of combustion, temperature control is achieved toward an intended higher temperature through operation of the electronic circuit.

Figure 5:
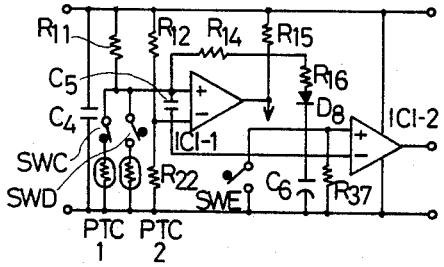
FIGS. 5 to 8 are circuit diagrams of other embodiments of the present invention.

FIG. 5 illustrates an alternative circuit for the circuit of FIG. 4, wherein negative-characteristic thermistors $PTC_1$ and $PTC_2$ are connected in place of the positive-characteristic thermistor 21 and three fuel-empty burning switches $SW_C$, $SW_D$ and $SW_E$ are installed. The function of the thermistor $PTC_1$ is to control warm-up temperature and the function of $PTC_2$ is to control fuel-empty burning temperature. Warm-up and combustion are performed under the normal combustion state when the switch $SW_C$ is "closed", $SW_D$ is "opened", $SW_E$ is "opened" and the thermistor $PTC_1$ is in use. Temperature regulation during the idle burning is achieved with the help of the thermistor $PTC_2$ when $SW_C$ is "closed", $SW_D$ is "closed", $SW_E$ is "closed." Because of $SW_E$ being in a closed position and $RY_2$ being in an off position, self-holding temperature is assured in the normal way through the operation of the electronic circuit and burning is carried out without load.

Figure 6:
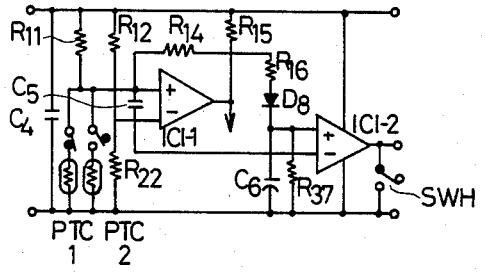

Another modification in the circuit version of FIG. 5 is illustrated in FIG. 6, with the difference being that in FIG. 5 $SW_E$ is placed on the input side of $IC_{1-2}$ to prevent the output of $IC_{1-2}$ from increasing to the "high" level, $SW_H$ rather than $SW_E$ is so placed on the output side of $IC_{1-2}$ in FIG. 6 so that the output of $IC_{1-2}$ is led to the minimum side of the circuit via $SW_H$ to keep $Q_3$ on.

Figure 7:
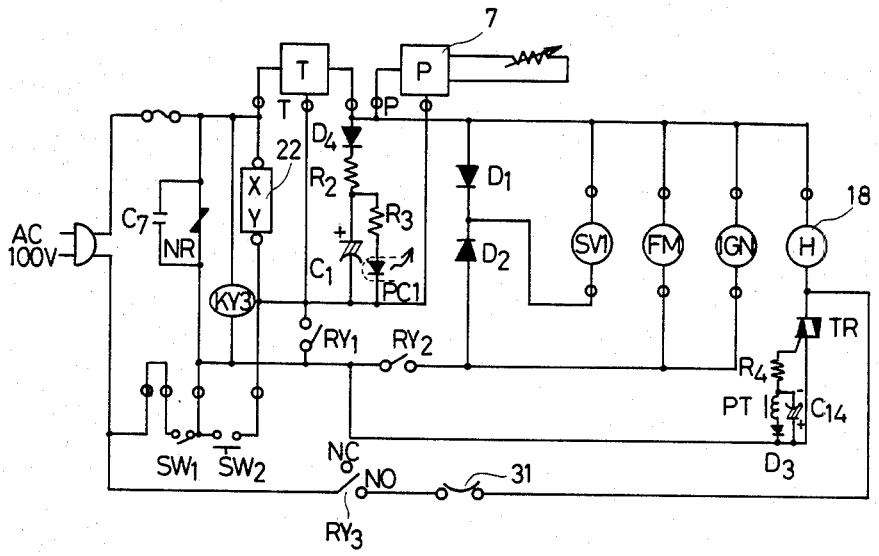

Another embodiment shown in FIG. 7 is adapted such that a series circuit of a relay $RY_3$ and a hot-air thermostat 31 is placed between the heater 18 and the power supply terminal so as to initiate the fuel-empty burning automatically immediately after the discontinuation of the combustion state. The relay $RY_3$ is a normally closed type switch that is opened in response to current flowing through its relay coil $RY_3$. The hot-air thermostat 31 is a switch that is in an on position while a hot atmosphere is present in the combustion chamber and the temperature of hot air is above a fixed temperature.

No current flows through the heater 18 prior to the start of combustion because of the magnet relay $RY_3$ being on and the thermostat 31 being off. The switches $SW_1$ and $SW_2$ are switched on to initiate combustion in the foregoing manner so that the thermostat 31 is turned on with a temperature rise in the combustion chamber. However, if the switch $SW_1$ is on, current will flow through the relay coil $RY_3$ but no current runs through the series circuit because of the relay $RY_3$ is deenergized.

When the switch $SW_1$ is switched off to discontinue combustion, current circulates through the heater 18, the thermostat 31 and the relay $RY_3$ to heat the fuel injector 1 in spite of the switch $SW_1$ being in an off position, for the relay $RY_3$ has been energized and the thermostat 31 has been switched on immediately after the start of combustion. In this case, the thermostat 21 does not work so that the temperature of the fuel injector 1 exceeds the temperature during the normal combustion state and reaches about 500° C., fulfilling the requirement of the fuel-empty burning. If the combustion chamber shows a slow decrease in temperature and the temperature of the hot air is below the fixed temperature, then the thermostat 31 is turned off, stopping power supply to the heater 18 and completing the fuel-empty burning.

Figure 8:
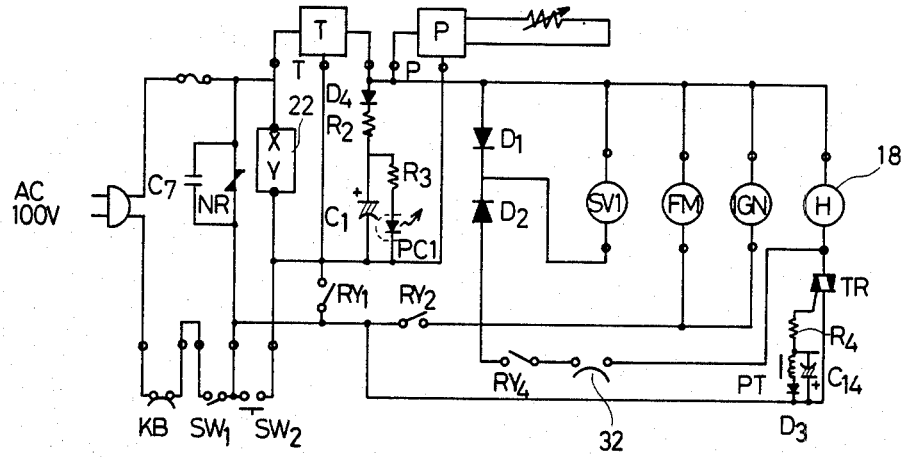

A circuit of FIG. 8 is different from that of FIG. 3 in that a series circuit of a relay $RY_4$ and a heat-sensitive switch 32 is placed between the heater 18 and the relay $RY_2$ to provide automatic execution of the fuel-empty burning immediately after the start of combustion.

The relay $RY_4$ is one that is switched on and off together with the relay $RY_2$. The heat-sensitive switch 32 is one that is placed at a specific distance from the combustion chamber and switched off when a given temperature is reached. Although the switch 32 is on prior to the start of combustion the heater 18 is supplied with no power due to the relay $RY_4$ being in an off position. Once the switches $SW_1$ and $SW_2$ have been switched on, the fuel injector 1 is heated up to the given temperature and the relay $RY_2$ is energized and whereupon the relay $RY_4$ is also energized the heater 18 is supplied with power regardless of the present state of the triac TR. As a result, the heater 18 continues heating the fuel injector 1 and proceeds with the fuel-empty burning.

Since combustion is triggered upon energization of the relay $RY_2$ and actuation of the ignitor IGN, the tar removed from the fuel injector during the fuel-empty burning is introduced and burned through the nozzle 3 as a mixture with the vaporized gas fuel. A small amount of smell is released as compared to the case where the tar is discharged from the nozzle 3 without being burned.

As combustion proceeds the atmosphere is warmed by heat originating from combustion, heating the periphery of the heat-sensitive switch 32. If the periphery of the heat-sensitive switch 32 reaches a specific temperature (say, 50°–80° C.), then the switch 32 is turned off, interrupting continued power supply to the heater 18 and completing the fuel-empty burning. The heater 18 operates only during the conduction of the triac TR, permitting temperature regulation relied upon the thermistor 21.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A fuel combustion apparatus of a fuel vaporizing type comprising:

a fuel injector for receiving liquid fuel and dispensing vaporized fuel;

a vaporizing chamber being formed within said fuel injector;

a vaporizing cylinder operatively positioned within said vaporizing chamber;

a vaporizing core operatively positioned within said vaporizing cylinder;

a heater being positioned adjacent to said fuel injector for heating liquid fuel supplied thereto;

supply means for supplying liquid fuel to said vaporizing chamber for vaporization of said liquid fuel by said heater;

control means for selectively deactivating the supply means while activating the heater for removing tar from within said fuel injector;

wherein said control means includes a timer and a thermistor for selectively controlling the heating of said fuel injector for a predetermined time at a predetermined temperature without fuel being supplied thereto for removing tar from said fuel injector.

2. A fuel combustion apparatus according to claim 1, wherein said vaporizing cylinder is coaxially positioned within said vaporizing chamber and said vaporizing core is coaxially positioned within said vaporizing cylinder.

3. A fuel combustion apparatus according to claim 1, and further including a spring for biasing said heater toward said fuel injector.

4. A fuel combustion apparatus according to claim 1, and further including a spring for biasing said vaporizing cylinder inwardly within said vaporizing chamber.

5. A fuel combustion apparatus according to claim 1, wherein said predetermined temperature during the removal of tar from said fuel injector is at an elevated temperature with respect to the temperature of said fuel injector during normal operation.

* * * * *